US006691415B2

(12) United States Patent
Quals

(10) Patent No.: US 6,691,415 B2
(45) Date of Patent: Feb. 17, 2004

(54) DEPILATORY CREAM RAZOR

(76) Inventor: Gregory Quals, P.O. Box 2640, North Hills, CA (US) 91393

( * ) Notice: Subject to any disclaimer, the term of this patent is extended or adjusted under 35 U.S.C. 154(b) by 34 days.

(21) Appl. No.: 10/112,914

(22) Filed: Mar. 29, 2002

(65) Prior Publication Data

US 2003/0182801 A1 Oct. 2, 2003

(51) Int. Cl.[7] ..... B26B 21/00
(52) U.S. Cl. ..... 30/32; 30/172; 30/41
(58) Field of Search ..... 30/32, 41, 47, 30/346, 346.5, 346.55, 172, 169; 15/245

(56) References Cited

U.S. PATENT DOCUMENTS

| | | | | | |
|---|---|---|---|---|---|
| 1,210,006 | A | | 12/1916 | Schmitt | |
| 1,558,021 | A | | 10/1925 | Libi | |
| 2,127,010 | A | * | 8/1938 | Sampson | 30/32 |
| 2,794,246 | A | * | 6/1957 | Marsh et al. | 30/32 |
| D248,878 | S | | 8/1978 | Halm | |
| 4,251,914 | A | | 2/1981 | Grosjean | |
| D269,466 | S | | 6/1983 | Gruber | |
| 4,473,944 | A | * | 10/1984 | Carroll | 30/41 |
| D282,878 | S | | 3/1986 | Skidmore | |
| 4,845,845 | A | | 7/1989 | Scott | |
| 5,343,622 | A | | 9/1994 | Andrews | |
| 5,402,697 | A | | 4/1995 | Brooks | |
| 5,522,137 | A | | 6/1996 | Andrews | |
| 6,473,971 | B2 | * | 11/2002 | Ordaz | 30/47 |

FOREIGN PATENT DOCUMENTS

| | | |
|---|---|---|
| GB | 2 294 229 A | 4/1996 |
| JP | 8-98965 | 4/1996 |
| JP | 11-33245 | 2/1999 |

* cited by examiner

*Primary Examiner*—Hwei-Siu Payer
(74) *Attorney, Agent, or Firm*—Richard C. Litman

(57) ABSTRACT

A depilatory cream removal device for scraping off applied depilatory cream from the face and other parts of the body with the advantage of movement in any direction.

3 Claims, 3 Drawing Sheets

DEPILATORY CREAM RAZOR

BACKGROUND OF THE INVENTION

1. Field of the Invention

The present invention relates generally to depilatory cream removal device. More specifically, the invention is a hand depilatory cream removal device designed specifically for men with heavy facial hair, and using a depilatory cream which is to be removed with the hair.

2. Description of the Related Art

The related art of interest describes various hand razors, but none discloses the present invention. There is a need for removing the depilatory cream and excess hair from the face and other hairy body portions. The related art is described below.

U.S. Pat. No. 1,558,021 issued on Oct. 20, 1925, to John J. Libi describes a safety razor with an exposed blade held by a plurality of curved tines attached to a handle.

U.S. Pat. No. 5,343,622 issued on Sep. 6, 1994, and U.S. Pat. No. 5,522,137 issued on Jun. 4, 1996, to Edward A. Andrews describes a bi-directional razor device comprising two pairs of narrow, strip-like razor blades are embedded in the head of the razor facing in opposite directions.

U.S. Pat. No. 4,845,845 issued on Jul. 11, 1989, to Avery Scott describes a plastic shaving device for use with a hair removal product. The head is one rectangular blade attached to a thin handle with a sharpened edge on an outside edge and a round tip.

U.S. Design Pat. No. 248,878 issued on Aug. 8, 1978, to Hans Halm describes an ornamental design of a razor with a handle having perforated angled slats in the handle.

U.S. Design Pat. No. 269,466 issued on Jun. 21, 1983, to Kurt Gruber describes an ornamental razor having an elliptical shaped head with square indents and a handle with a pair of grooved edges on two parallel sides.

U.S. Design Pat. No. 282,878 issued on Mar. 4, 1986, to Herbert M. Skidmore describes an ornamental razor having a head not perpendicular to the handle.

U.S. Pat. No. 1,210,006 issued on Dec. 26, 1916, to John H. Schmitt describes a safety razor comprising a single piece of wire to form the head and handle.

U.S. Pat. No. 4,251,914 issued on Feb. 24, 1981, to Warren J. Grosjean describes a shaving assembly comprising a one-piece blade seat and and an angled handle made of molded polystyrene-type plastic. A blade cap is secured to the blade seat with the blade. The blade cap has a protruding and upwardly inclined edge which supports the blade.

U.S. Pat. No. 5,402,697 issued on Apr. 4, 1995, to Shirley E. Brooks describes a depilatory applicating razor comprising a one-piece device having multiple blades or three rotary cutting heads with a depilatory reservoir in the handle for discharging the depilatory cream proximate the blades or cutting heads and a required tensioning means comprising one or two end rollers to stretch the skin.

Japan Patent Application No. 8-98965 published on Apr. 16, 1996, for Seiji Kanematsu describes a safety razor with a curved handle to prevent fingers from touching the shaving cream.

U.K. Patent Application No. GB 2 294 229 A published on Apr. 24, 1996, for Cyril R. Benton describes a safety razor with an angled head not perpendicular to the handle.

Japan Patent Application No. 11-33245 published on Feb. 9, 1999, for Noboru Kurihara describes a safety razor with a curved handle and a removable edge body or shaving head.

None of the above inventions and patents, taken either singularly or in combination, is seen to describe the instant invention as claimed. Thus, a depilatory cream removal device solving the aforementioned problems is desired.

SUMMARY OF THE INVENTION

The present invention is a novel hand depilatory cream removal device specifically adapted for the removal of dry depilatory cream from the face and the like. Hirsute men, especially of African heritage, have thick curly facial hair which preferably is removed. However, shaving this facial hair continuously could result in a tougher thicker outgrowth. Therefore, a depilatory cream is used. However, the dried depilatory cream cannot be readily removed by a conventional sharp razor with its restricted directional movement. Thus, a hand depilatory cream removal device according to this invention can be used in any direction on the face, because the conventional safety guard has been dispensed with. The device can also be used on other parts of the body such as the hands, arms and legs with greater freedom of movement than with the conventional razor.

Accordingly, it is a principal object of the invention to provide a specially constructed depilatory cream removal device for removing applied depilatory cream from the user's face and the like.

It is another object of the invention to provide a specially constructed depilatory cream removal device for removing applied depilatory cream from the user's face and the like by eliminating the use of a safety guard.

It is a further object of the invention to provide a specially constructed depilatory cream removal device for removing applied depilatory cream from the user's face and the like by eliminating the need for a safety guard on a depilatory cream removal device, allowing the freedom of multi-directional movement.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

DETAILED DESCRIPTION OF THE PREFERRED EMBODIMENT

The present invention is directed to a depilatory cream removal device for removing applied depilatory cream and the undesired facial hair of hirsute men, especially of African descent. An ordinary razor device requires a razor guard structure which prevents movement of the razor in any other direction than in the direction of the handle. Therefore, removal of the applied depilatory cream on one's face by a conventional razor would be inhibited by the requirement of moving the razor in the direction of the handle. Whereas, the present invention has been shown to quickly and adequately remove the applied depilatory cream and facial hair by having the mobility to move across the face in any direction to effectively remove the dried depilatory cream.

Figure 1:
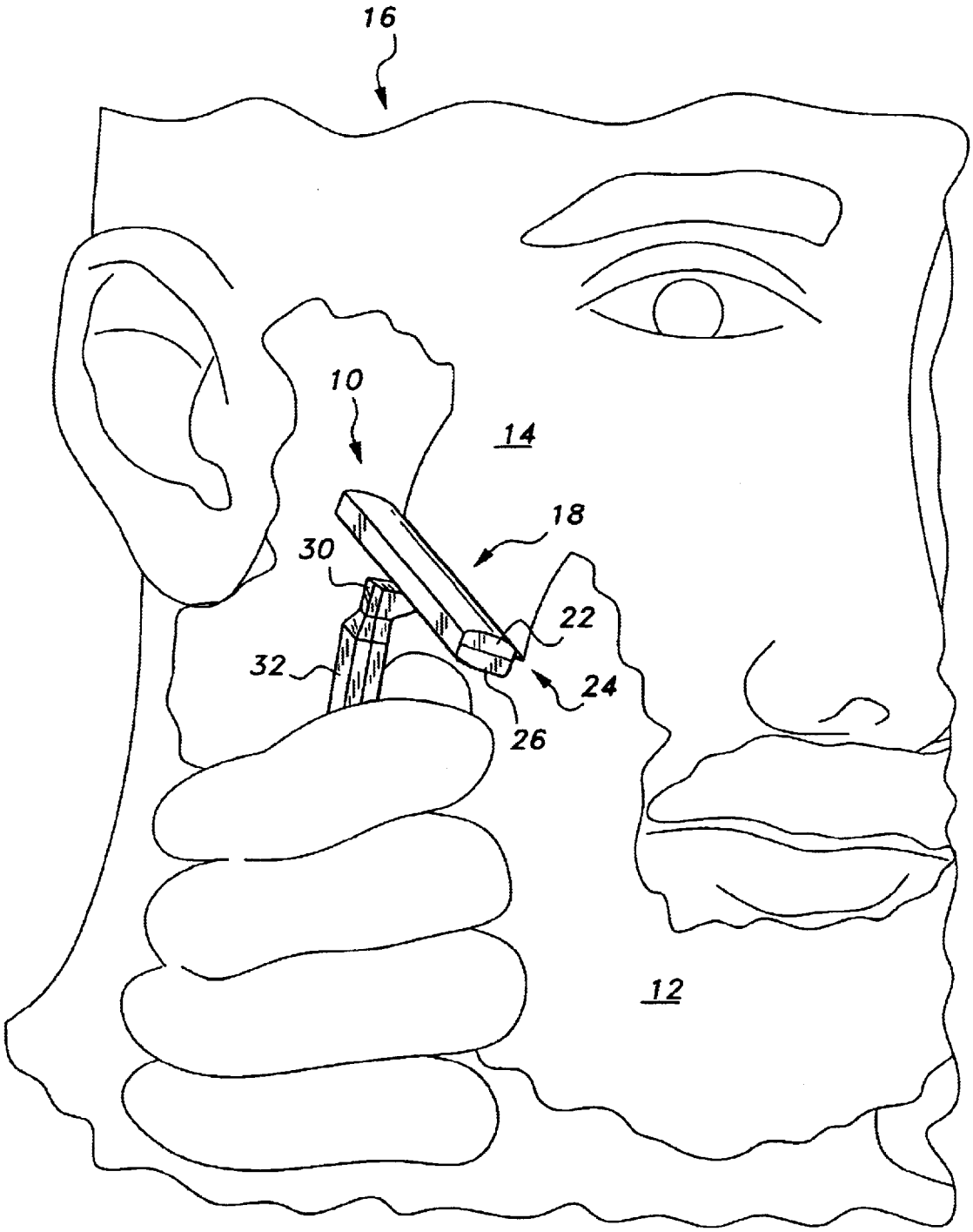
FIG. 1 is an environmental, perspective view of a depilatory cream removal device according to the present invention.
Figure 2:
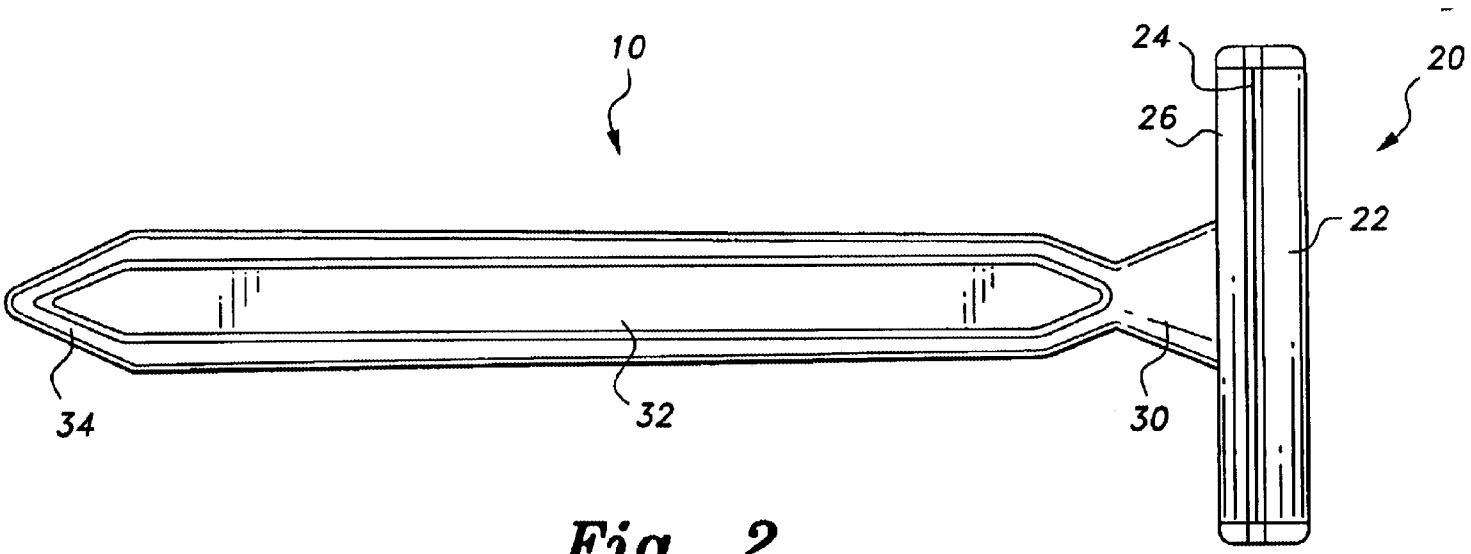
FIG. 2 is a front elevational view of the depilatory cream removal device.
Figure 3:
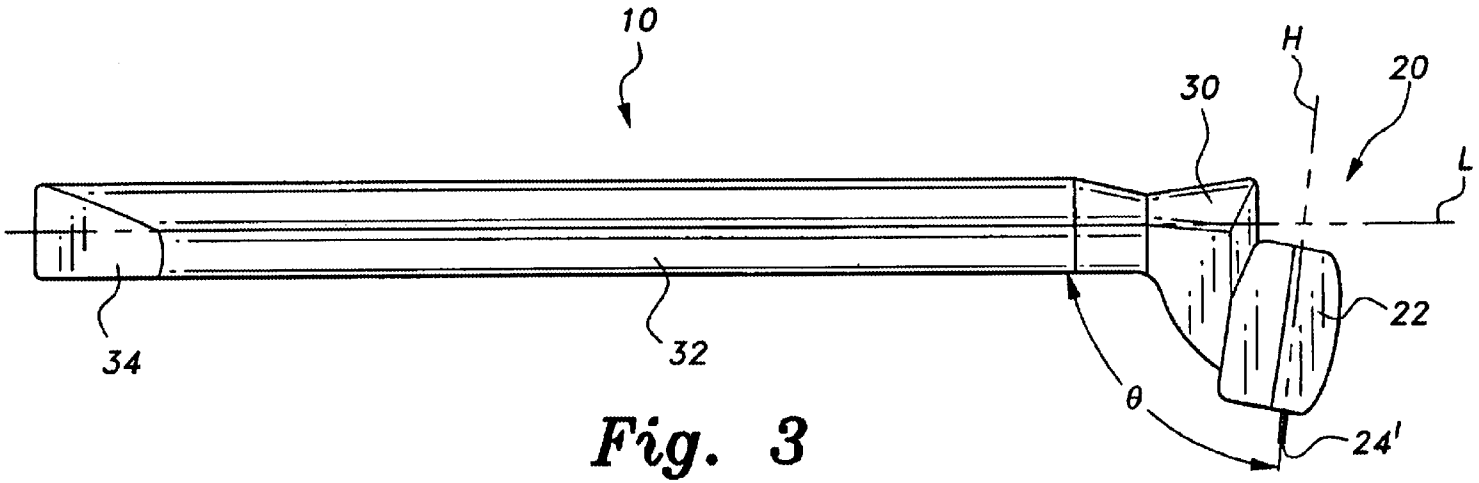
FIG. 3 is a side elevational view of the depilatory cream removal device.
Figure 4:
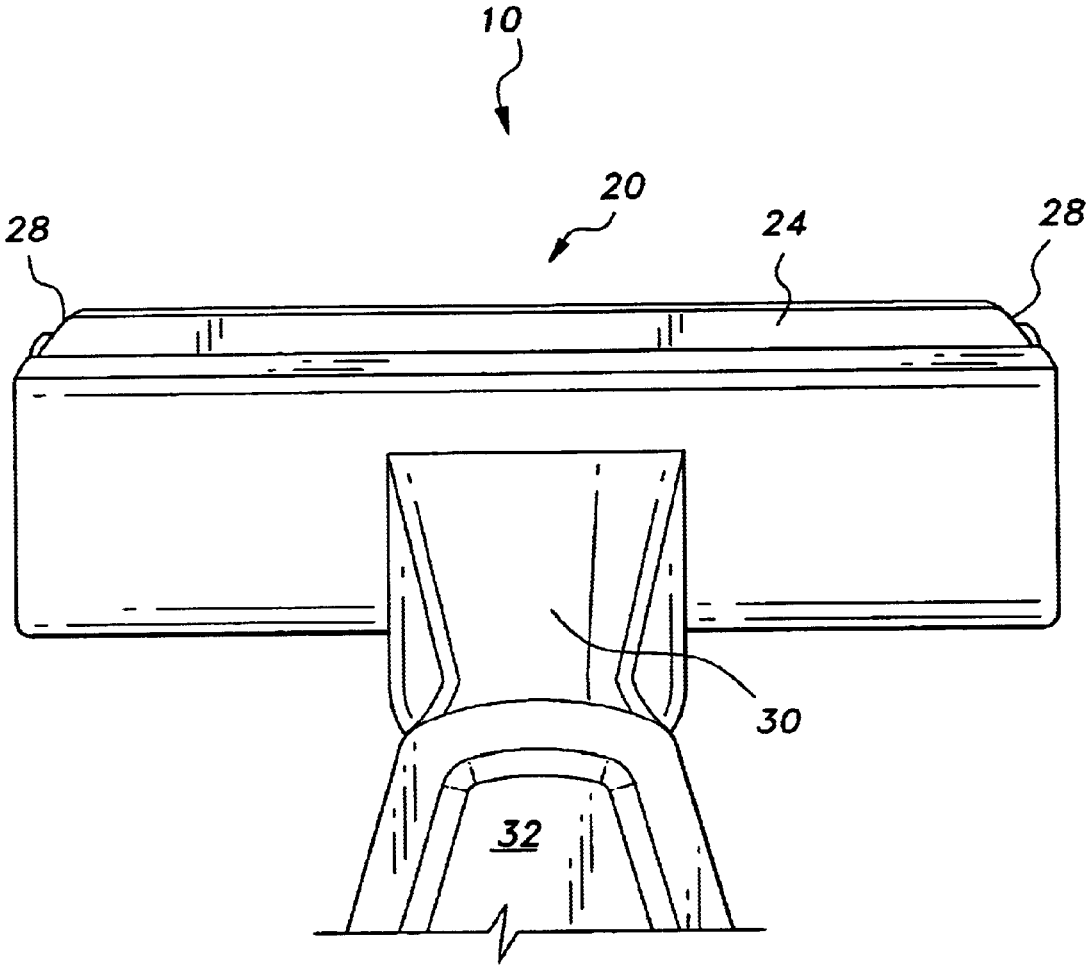
FIG. 4 is an enlarged bottom perspective view of the depilatory cream removal device with a partial view of the handle.

In FIG. 1 a depilatory cream depilatory cream removal device 10 is illustrated removing the applied depilatory cream 12 from the cheek area 14 of a man 16 with thick facial hair 18. FIGS. 2, 3 and 4 show various views of the depilatory cream removal device 10. The head 20 comprises only two parts with the top piece 22 having an embedded scraping blade 24 and attached to the bottom piece 26. The scraping blade 24 has rounded external corners 28 unlike the conventional razor blade. In addition, the scraping blade 24 has a blunt edge 24' (see FIG. 3), thus the scraping blade 24 is incapable of cutting the hair of a person.

The scraping blade head 20 is offset from its base 30 to angle the scraping blade head 20 downward as depicted in FIG. 3. The handle 32 has a longitudinal axis L, and the scraping blade head has an axis H; such that the angle θ is an acute angle. The elongated straight handle 32 extends and ends in a chiseled but blunt point 34 for removing specific dried portions inaccessible by the blade 24.

The depilatory cream removal device 10 can be economically made of colored plastic. The manufacture of this device does not require expensive molding and shaping associated with metal shavers.

It is to be understood that the present invention is not limited to the embodiment described above, but encompasses any and all embodiments within the scope of the following claims.

I claim:

1. A depilatory cream removal device comprising:

a scraping blade having a blunt edge and rounded corners;

a scraping blade holder commensurate in size and shape to hold said scraping blade;

said scraping blade holder being constructed to expose more of said scraping blade and permit scraping in any direction; and a handle having a blunt chiseled tip;

said scraping blade holder being connected to said handle at an end opposite the blunt tip, and at an acute angle with respect to a longitudinal axis of said handle;

whereby a person with undesirable facial hair can remove applied depilatory cream with the undesirable hair by moving the removal device in any direction, and said scraping blade being incapable of cutting the hair of the person.

2. The depilatory cream removal device according to claim 1, wherein the scraping blade is made of metal.

3. The depilatory cream removal device according to claim 1, wherein the scraping blade holder and said handle being made of colored plastic.

* * * * *